United States Patent [19]

Latimer et al.

[11] 4,346,937

[45] Aug. 31, 1982

[54] DREDGING APPARATUS INCLUDING SUCTION NOZZLES

[75] Inventors: John P. Latimer; Robert M. Donaldson; Ted W. Christian; Glenn E. Miller, all of Newport News, Va.

[73] Assignee: Deepsea Ventures, Inc., Gloucester Point, Va.

[21] Appl. No.: 155,316

[22] Filed: Jun. 2, 1980

[51] Int. Cl.[3] ..... E02F 7/00

[52] U.S. Cl. ..... 299/8; 37/57; 37/DIG. 8

[58] Field of Search ..... 299/8, 9; 37/57, DIG. 8

[56] References Cited

U.S. PATENT DOCUMENTS

| | | | |
|---|---|---|---|
| 3,646,694 | 3/1972 | Beck | 299/8 X |
| 3,829,160 | 8/1974 | Condocios | 37/DIG. 8 X |
| 3,971,593 | 7/1976 | Porte et al. | 37/DIG. 8 X |
| 3,975,054 | 8/1976 | Brockett et al. | 299/8 |
| 4,070,061 | 1/1978 | Obolensky | 299/8 |

FOREIGN PATENT DOCUMENTS

| | | | |
|---|---|---|---|
| 2643041 | 4/1977 | Fed. Rep. of Germany | 299/8 |

*Primary Examiner*—Ernest R. Purser
*Attorney, Agent, or Firm*—Barry G. Magidoff

[57] ABSTRACT

There is provided a dredge vehicle supporting a dredge assembly for collecting ore particles from the ocean floor. The dredge assembly includes several nozzles extending forwardly of the supports for the vehicle, pump means for developing a suction flow into and through the nozzles and a screen to separate the ore particles from most of the water before feeding the ore into, e.g., an airlift system leading to a surface vessel. Preferably, an intake of clear water from above the vehicle is used to carry the ore to and up the airlift system.

Advantageously, the water flows straight through the system and exhausts from the rear of the vehicle, and mud is cleared from the ore before bringing the ore to the surface.

22 Claims, 9 Drawing Figures

84
90
90
91
91
69
61c
85
86
87
63a
65
A
59
88
49
161
55
51

DREDGING APPARATUS INCLUDING SUCTION NOZZLES

This invention is directed to means for dredging particles from the floor of a body of water, and especially for the mining of ocean floor nodule ores from the surface of the ocean floor.

With the recognition that terrestrial sources for raw materials, especially ores, are being swiftly depleted, effort has been made to obtain these valuable industrial raw materials from other sources, most especially the abyssal depths of the oceans. Such sources are generally to be found at depths of between 10,000 and 18,000 feet, requiring extremely deep water dredging means. The most valuable ores found to date are known as ocean floor nodule ores, or manganese nodules. These materials are often found as relatively small particulate forms, including fist-sized rocks or smaller pebbles, or even as grains of sand.

A great deal of engineering effort has been undertaken to date to secure these ores and bring them to the surface for further processing.

The deposits of these valuable metal ores are often lying on the surface of the soft sea floors, in the form of fist-sized rocks, often partially immersed within a sediment layer on the ocean floor. The exact size of the ore pieces vary greatly, from relatively small pebbles or even sand-like grains, up to large rocks or even boulders. The smaller of such ore pieces can be directly secured by one form of mining machine designed to date, and that is the suction head dredge vehicle.

Such a suction-type dredging apparatus literally sucks the ore particles, much in the way of a vacuum cleaner, into the mining system, eventually transferring the thus collected particles via elevator means from the dredge vehicle to a surface vessel. The present preference is to carry the ore particles to the surface vessel entrained in liquid, especially sea water, and most especially in an airlift system.

When dredging for the valuable nodule ores at the bottom of the ocean, the ore gathering device should be as efficient as possible, in order to compensate for the great expense of collecting the ore from a location at least about 3 miles beneath the surface of the ocean. A further problem which has been raised, although without specific factual evidence, is the bringing of a significant amount of the mud from the ocean floor to the surface, along with any possibly deleterious substances or microbial organisms. Finally, the surface of the ocean floor is not a smooth plane, but is broken by many relatively small irregularities, extending, as is often the case on dry land, transversely to each other.

In accordance with the present invention, means are provided to collect particulate solids from the bottom of a body of water, and more especially from the ocean floor, utilizing a negative pressure of suction, to draw, e.g., the ore particles, into the collection system. The present invention provides most broadly for an improved disposition of the ore collection system upon a vehicle capable of moving along the ocean floor, and for a system of carrying the ore particles from the collection inlet to the elevator means. In accordance with the present invention, there is provided a dredge vehicle, preferably including support means for supporting the vehicle on the ocean floor, and a dredging assembly comprising:collection means to collect particles mixed with a relatively large quantity of water, and located at a forward portion of the vehicle; conduit means in fluid flow connection with the collection means and extending longitudinally rearwardly along the vehicle; pumping means to accelerate the flow of the water into and through the collection means and rearwardly through the conduit; ore particle screening means in the conduit to separate ore particles from at least a portion of the relatively large quantity of water; exhaust means to exhaust the separated water from the conduit; and means designed to feed ore particles from the screen to an ore elevator leading to the surface.

In a series of preferred embodiments, the dredge vehicle is supported on support means, designed to rest upon the ocean floor, and the collection means is located forwardly of the support means. Further, the collection means is pivotally supported on the vehicle. There are also preferably provided a second ore particle screening means to separate at least a majority of any remaining water from the previously separated ore particles, and means to feed substantially clear water to the separated ore particles being fed to an ore elevator.

In a further preferred embodiment, the pumping means is a centrifugal type pump located in line within the conduit between the collection means and the ore particle screening means. The ore particles most preferrably pass through the impeller of the pump. The collection means is preferably a suction-type nozzle pivotably supported from the forward end of the dredge vehicle and extending downwardly such that the opening to the nozzle is suspended adjacent the ocean floor. In a most preferred embodiment a plurality of such nozzles are arrayed transversely across the forward portion of the dredge vehicle and extend forwardly of the support means, so as to sweep a forward portion including that area to be traversed directly under the support means. By arraying the nozzles in a staggered formation, a continuous surface area can be swept by the collection nozzles, thus significantly improving the possible collection rate for a dredging means.

The invention defined herein is exemplified by the embodiments described hereinbelow and illustrated in the accompanying drawings. The preferred embodiments are presented herein to provide a more clear understanding of the invention and its advantages, and not to limit the scope of the invention.

Figure 1:
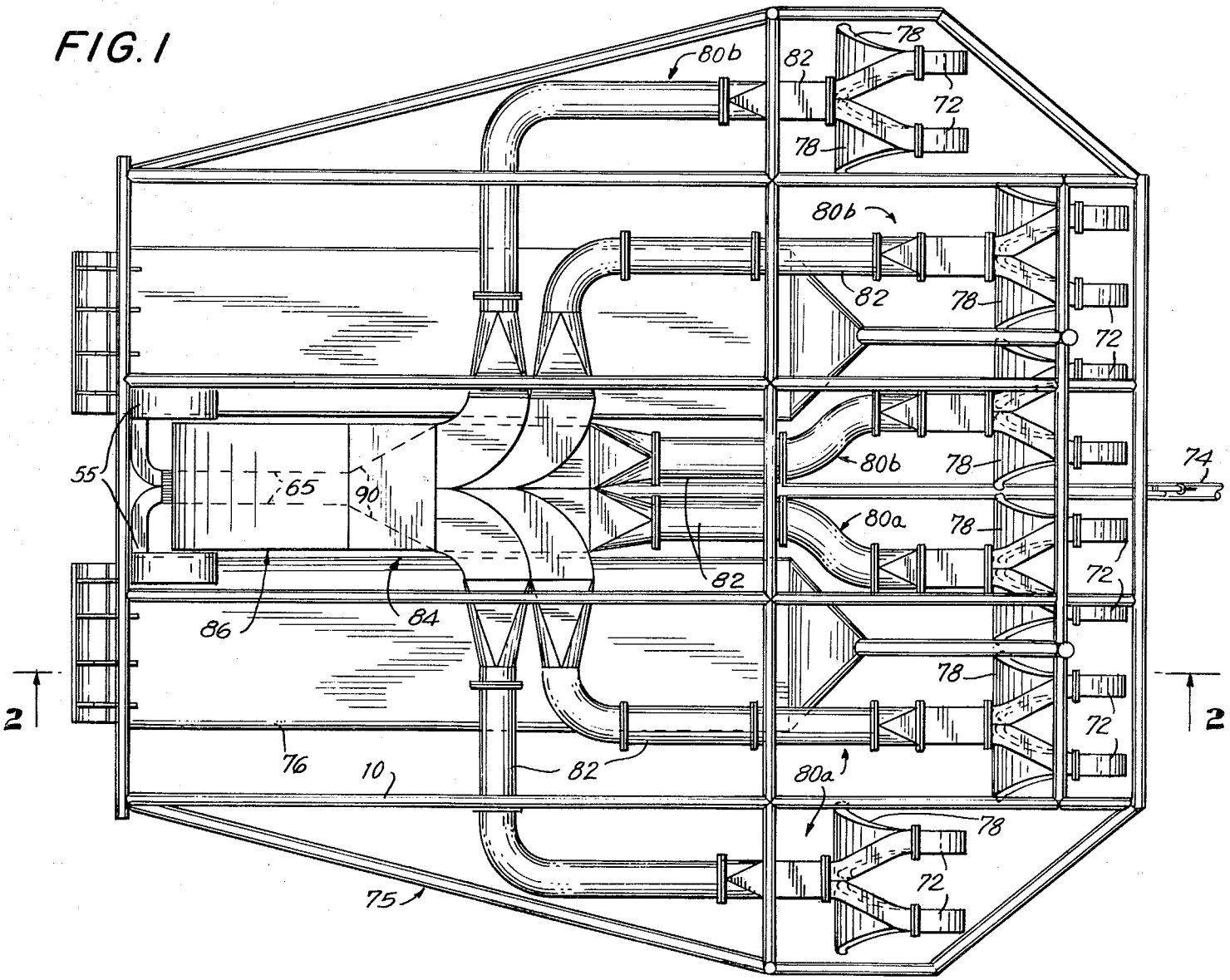
FIG. 1 is a plan view showing a suction nozzle-type dredge vehicle including the present invention.
Figure 2:
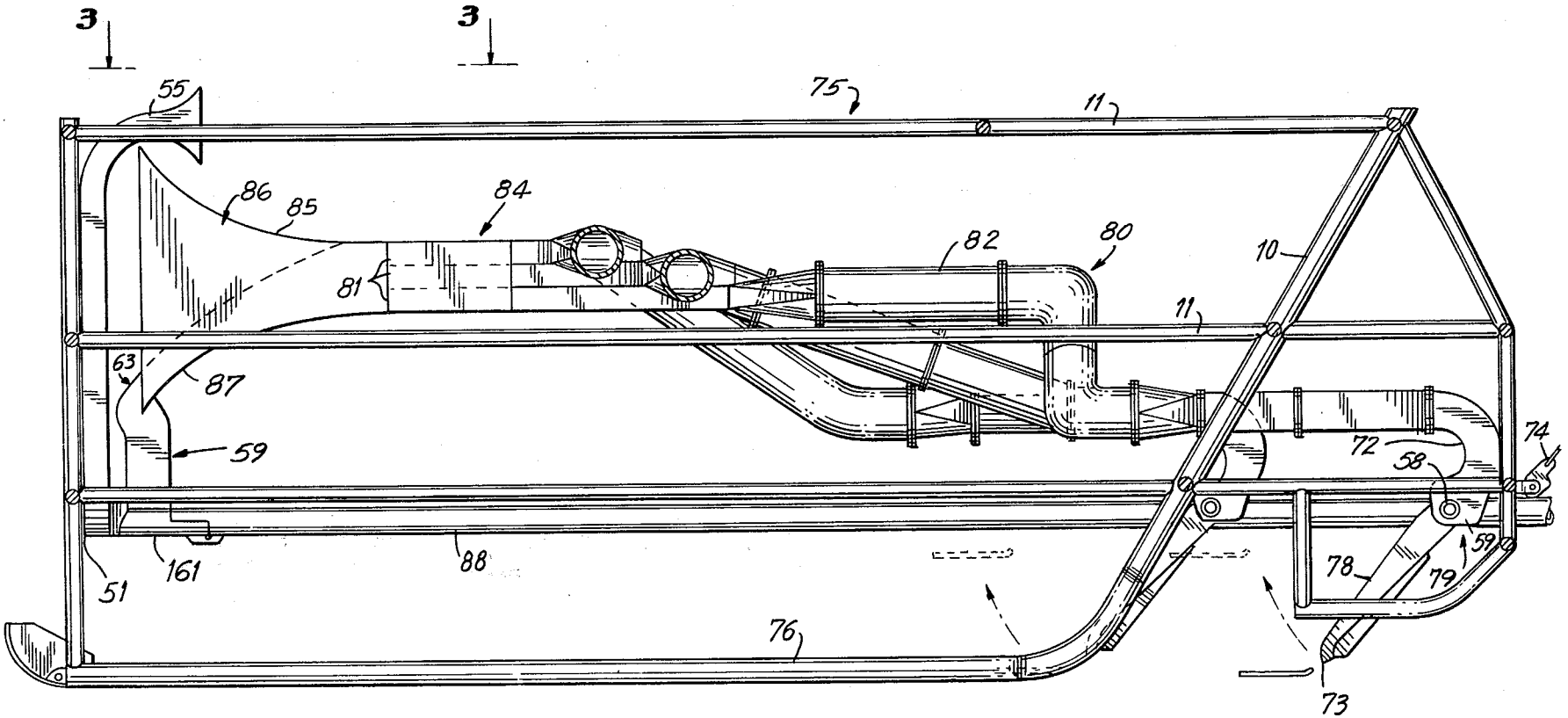
FIG. 2 is a side elevation view of the dredge vehicle of FIG. 1.

In FIG. 1, the dredge vehicle, generally indicated by the numeral 75, includes skids or runners 76 for supporting the dredge vehicle on the ocean floor. The dredge 75, as shown, is intended to be towed from a surface vessel, from the forward portion of the dredge vehicle as by the cable 74.

The dredge vehicle 75 is of a generally skeletal structure, formed of intersecting, substantially vertical and horizontal members 10, 11, respectively, supporting a dredge assembly, as follows.

A plurality of suction-type nozzles 78 are arrayed transversely across the forwardmost portion of the vehicle 75, numbering twelve in the embodiment shown. A pair of nozzles 78 are connected via primary ducts 72 into a combined duct, generally indicated by the numeral 80. Each of the ducts 80, 72, and the nozzles 78 are ultimately supported on the dredge vehicle 75. The nozzles 78 are pivotally connected about a generally horizontal nozzle pivot axis 79 to each of the primary ducts 72; see FIGS. 6 and 7; or the conventional pillow-block connection can be used.

A pump 82 is located within each duct 80, such that any fluid passing through the duct 80 passes in line through the pump 82 and its impeller chamber, which is not shown in detail. The six ducts 80 in this embodiment of the invention are brought together at a stripper section, generally indicated by the numeral 84. The pump is preferably a mixed flow, propeller-type pump, which is not damaged by passage of the module ore particles through the impeller chamber.

The arrangement of nozzles shown, e.g., FIG. 1, provides a substantially continuous collection area over the surface as the dredge vehicle moves on the ocean floor, permitting sweeping the area immediately forward of the runners 76 as well as on either side of the runners.

Figure 4:
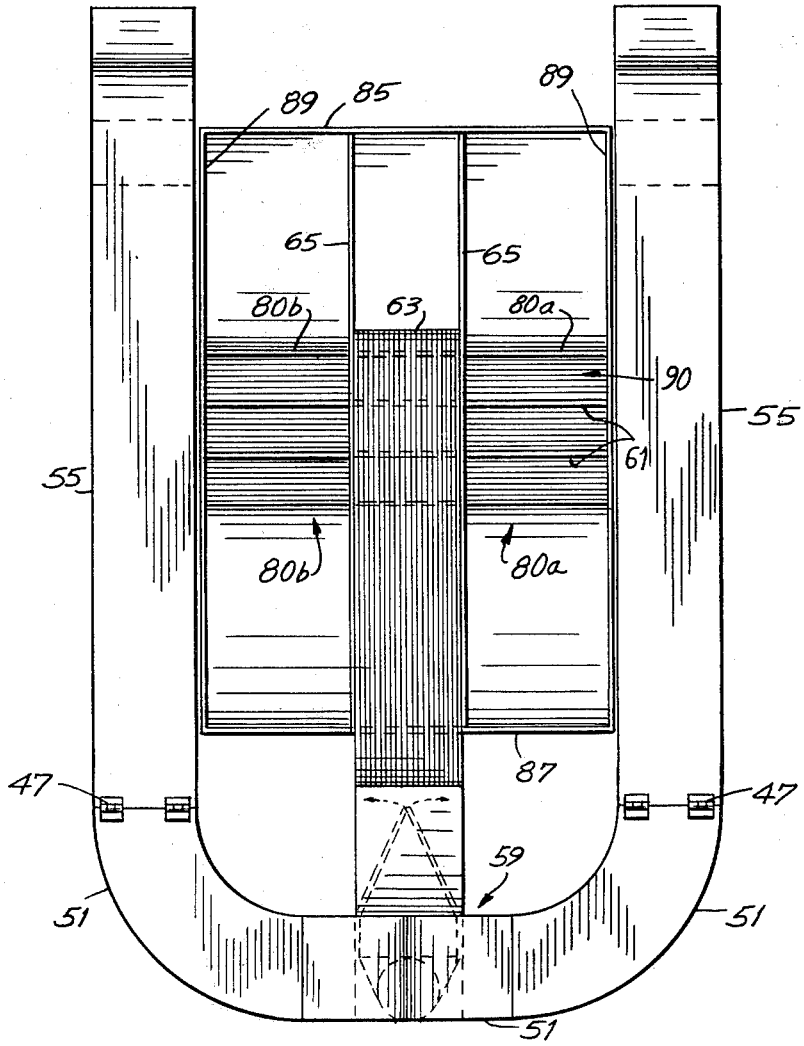
FIG. 4 is a view taken along lines 4—4 of FIG. 3.
Figure 5:
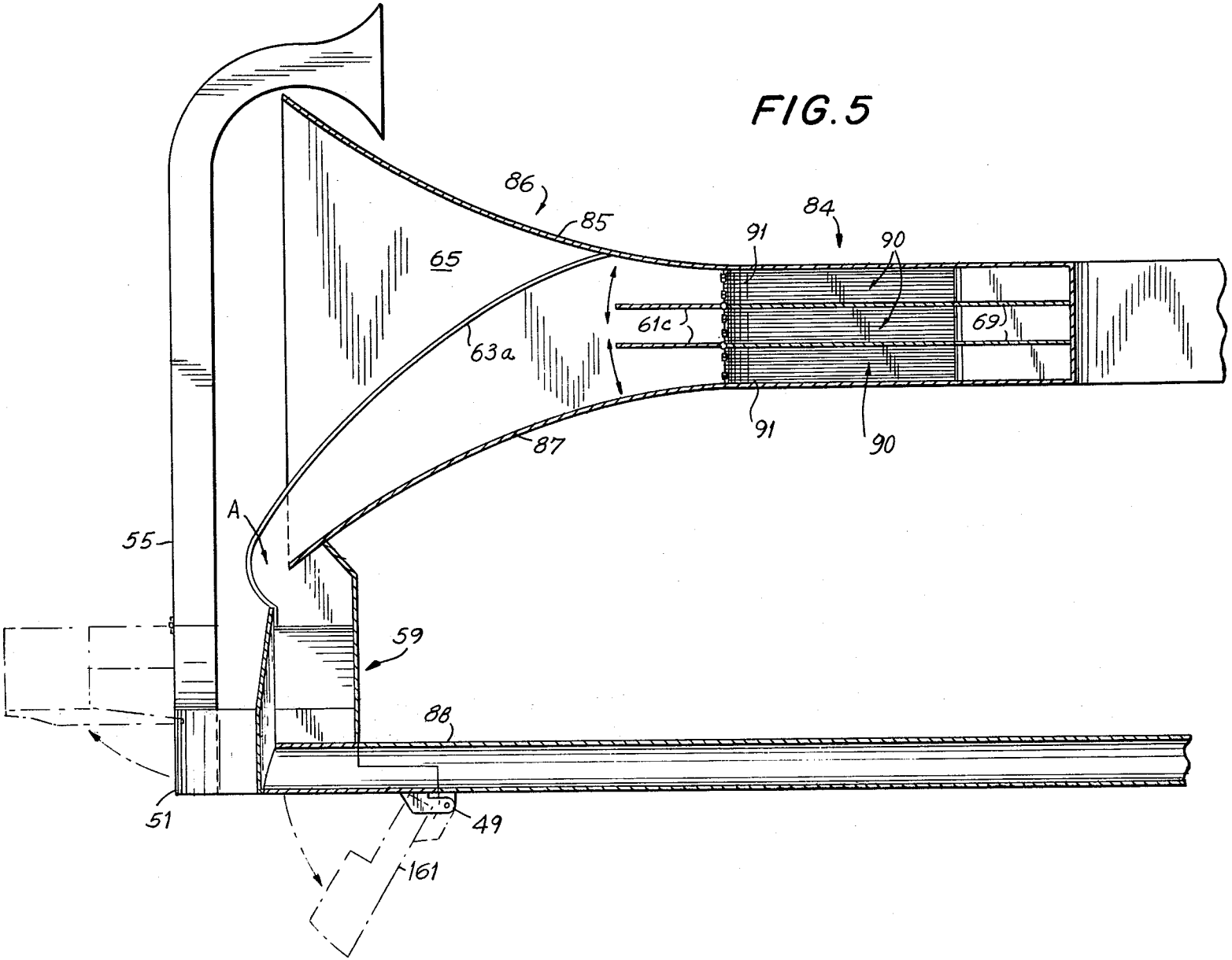
FIG. 5 is a section view along lines 5—5 of FIG. 3.

In the stripper section 84, as shown, the ducts 80 from each pair of nozzles 78 come together both laterally and vertically, such that all of the ducts from one side of the centerline of the dredge vehicle come together in vertical columns, e.g., the ducts 80*a* are located on the right-hand side of FIG. 4 and the ducts of 80*b* are arrayed vertically on the left-hand side of FIG. 4. It is preferred that each of the ducts 80*a*, 80*b*, when joined in the vertical columns in the stripper section 84, maintain substantially the same cross-sectional area, albeit of a different shape, from that in the upstream portions of the combined ducts 80. Each of the ducts 80*a*, 80*b*, in the vertical columns are shown substantially rectangular in cross-section, and include therein a nodule-separating screen 90 extending diagonally across a portion of each of the ducts 80*a*, 80*b*. Each of the nodule screens 90 are formed of relatively slender stripper bars 91 extending diagonally across each duct 80*a*, *b* as shown in the drawing of FIG. 5. The vertical separation between the stripper bars is determined by the desired minimum size of the ore particle to be collected. Water and particles smaller than the desired minimum size can pass through the screen 90 between the stripper bars 91.

In fluid flow connection with the stripper section 84 is a trumpet-shaped diffuser manifold, generally indicated by numeral 86, flaring outwardly in a vertical direction, as defined by curved, diverging upper and lower surfaces 86, 87, but maintaining a substantially constant lateral width as the stripper section 84, as defined by parallel side walls 89. The manifold 86 is in turn laterally divided into several flow sections by vertical inner walls 65 which extend the full length and height of the diffuser manifold 86 from the pivoting ends of the nodule separating screens 90; the inner walls 65 define a central flow section within the manifold 86. A secondary separating screen 63 extends in an arc downwardly and longitudinally through the manifold 86, from the inner surface of the upper diverging wall 85, adjacent the stripper section 84 to beyond the rear of the lower diverging wall 87, and transversely between the inner walls 65. The inner walls 65 and the arcuate transverse secondary screen 63 define an airlift feed chute extending beyond and below the lower diverging wall 87.

The secondary screen 63 is formed of a plurality of the long slender bars, preferably of the same cross-section diameter and spacing as in the primary screens 90. An individual slender rod 63*a* is seen in FIG. 5.

The vertically arrayed ducts 80*a*, 80*b* in the stripper section 84 are separated by parallel horizontal plates 69 which terminate at the beginning of the diffuser manifold section 86, i.e., coterminus with the screens 90. Segmented diffuser plates 61 are hingedly connected to the ends of the horizontal plates 69, and extend outwardly into the diffuser section 86. A segment of each diffuser plate 61 extends across substantially the full width of each flow section within the manifold 86. Each segment 61*a,c,c* is capable of pivoting upwardly and downwardly in response to changes in pressure resulting from variations in flow within each of the vertically arrayed ducts 80*a*, 80*b*. Pivoting of a diffuser plate 61 an substantially close off a duct 80*a*, *b*, in the event of, e.g., a malfunction of a pump 82. This can avoid undesirable fluid flow problems in the diffuser section 86.

The two outer flow sections of the diffuser manifold 86, i.e., on either side of the inner plates 65, exhaust into the open ocean. The central flow section, i.e., between the two vertical plates 65, at its lower, rearmost portion, connects into a second manifold section, generally indicated by the numeral 59. The two fresh water ducts 55, extending downwardly from above the dredge vehicle also are in fluid flow connection with the second manifold 59. The upper end of each fresh water duct 55 is open and faces forwardly, to collect clear, fresh water from above the mud cloud formed by the moving dredge on the muddy ocean floor. An airlift suction pipe 88, in fluid flow connection with the second manifold 59, at its rear end, extends forwardly, to the front of the dredge vehicle, connecting into the vertically extending airlift pipe to a surface vessel.

To provide means for dumping any blockage that may form in the secondary manifold section 59, or in the suction pipe 88, hydraulically operated dump doors 81 and 51, are provided at the lower rearmost portion of the suction pipe 88, and second manifold 59, pivoting about hinges 49 and 47, respectively.

Figure 6:
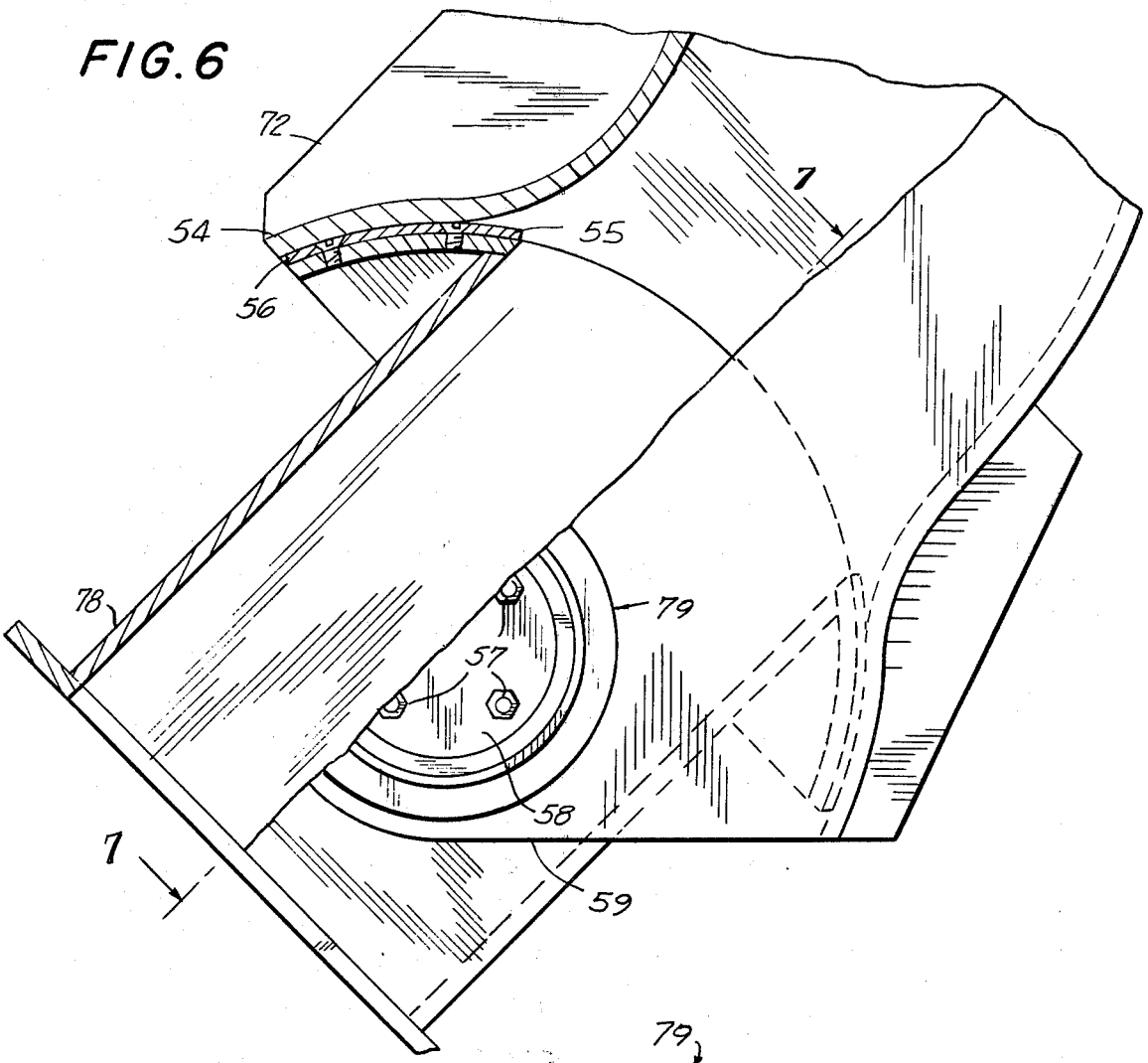
FIG. 6 is an enlarged view of the connection between a dredge nozzle and the duct work.
Figure 7:
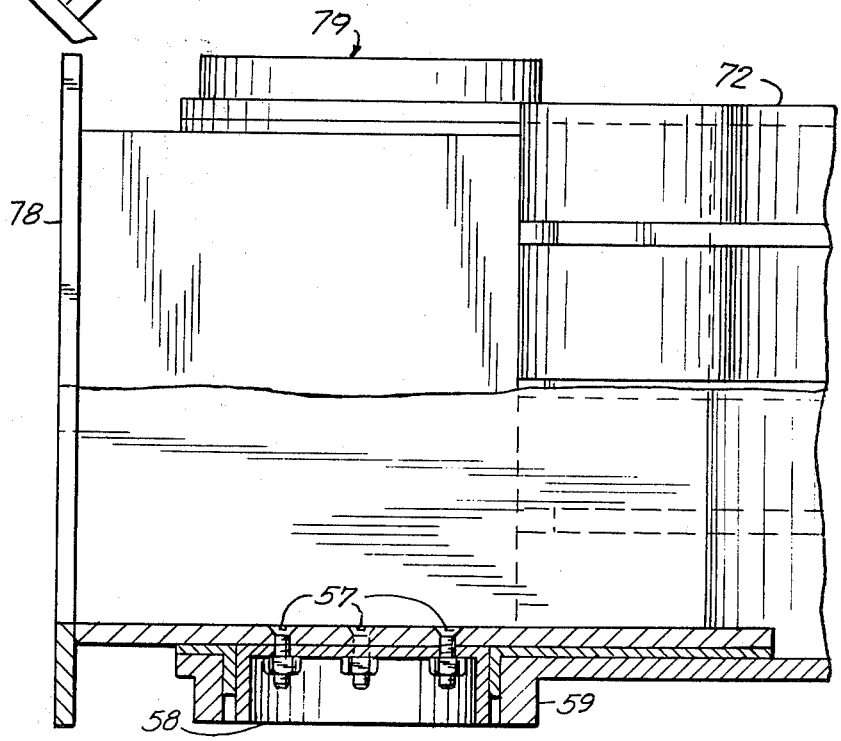
FIG. 7 is a section view along lines 7—7 of FIG. 6.
Figure 8:
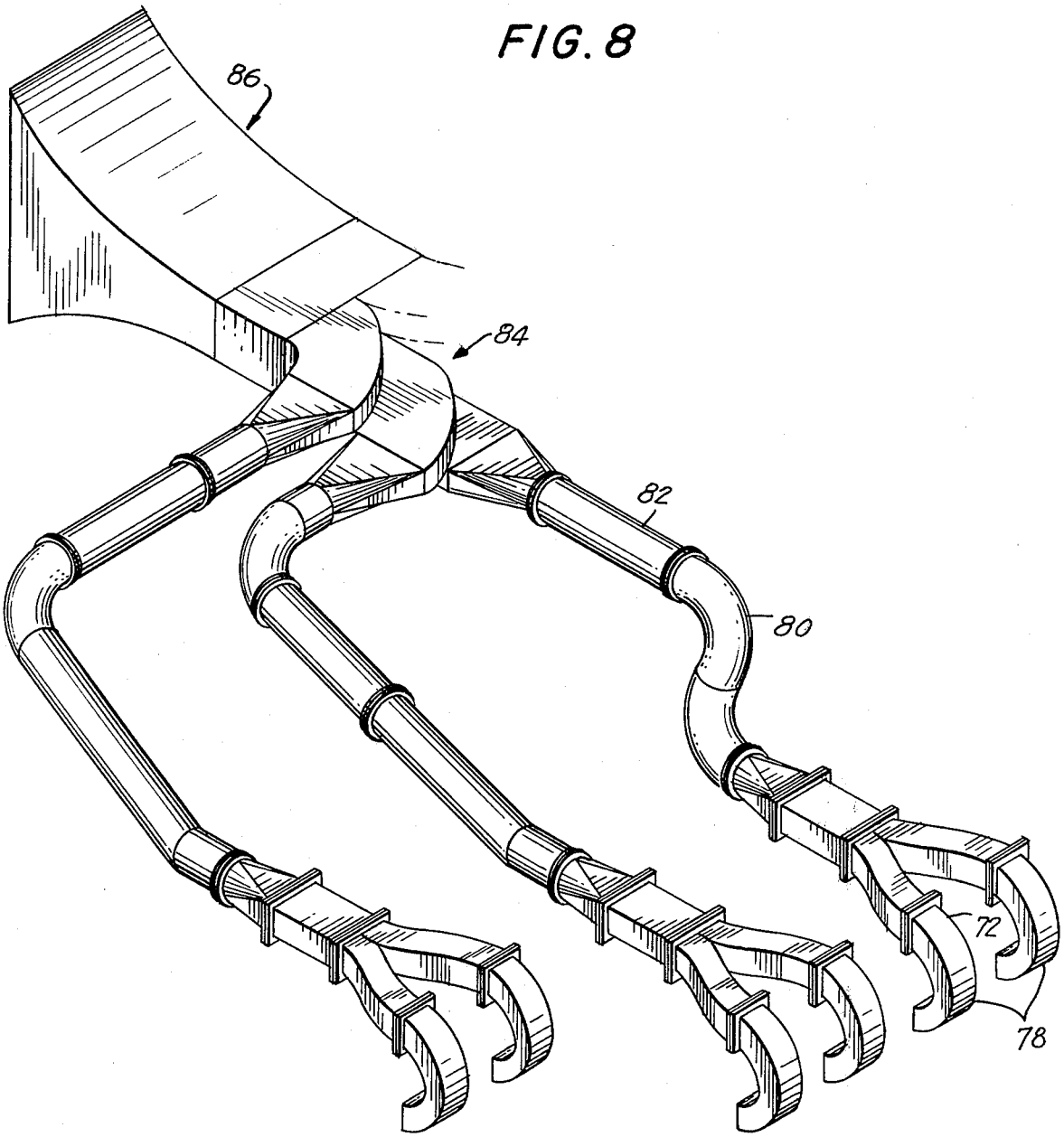
FIG. 8 is a rendering of a portion of this embodiment of the dredge assembly of this invention.
Figure 9:
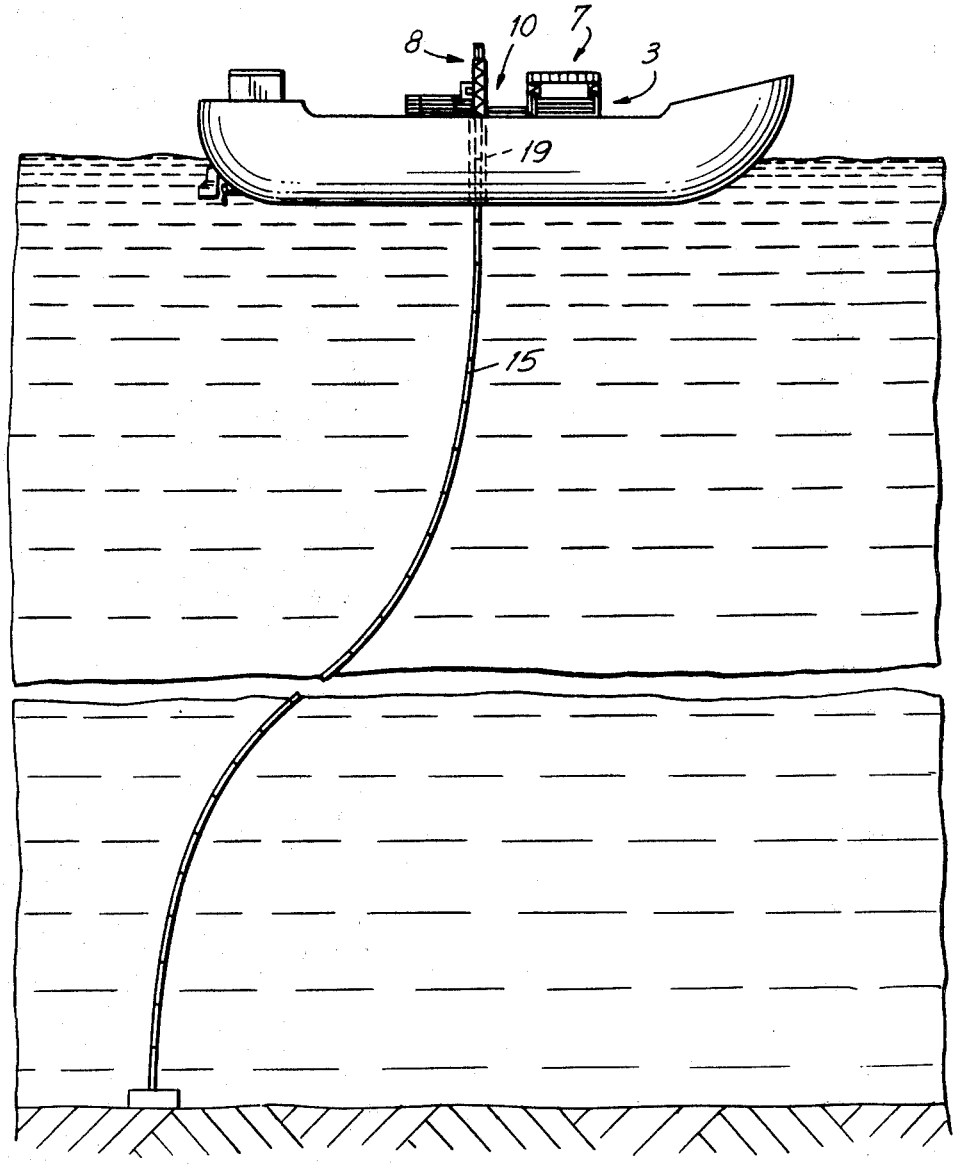
FIG. 9 is a diagrammatic sketch showing a surface vessel towing a dredge.

FIGS. 6 and 7 depict a novel pivot joint arrangement for each of the nozzles 78. In this embodiment, the nozzle 78 is supported from the duct 72, without requiring any direct structural connection to the dredge vehicle chassis. The duct 72 is fabricated with sufficient structural strength and rigidity to be able to support the nozzle 78 as it pivots during operation. A portion of the duct 72 extends downwardly on either side of the upper portion of the nozzle 78 to form a pivot plate 59 defining journal openings, generally indicated by the numeral 79. A cup-shaped journal bearing member 58 rotates within each journal opening 79. The upper portion of the nozzle 78 is bolted to the journal bearing members 58 by the threaded bolts 57 on two sides of the nozzle 78. The upper end of the nozzle 78 is provided with arcuate surfaces 55, faced with a bearing material, such as Teflon 55. The arcuate bearing material 55 moves over mating surfaces within the extended pivot plate portion of the duct 72, which also define the flow connection between the duct 72 and nozzle 78.

In the operation of the illustrated dredge assembly in accordance with the present invention, the dredge vehicle is towed by the surface vessel while being supported on the runners 76 on the surface of the ocean floor. The pumps 82 are energized, creating a suction, or negative pressure, within the ducts 72 and in the nozzle 78, and thus causing an inward flow of ocean water through the lower nozzle opening. The inward flow of water carries along with it the nodule are particles that are scattered on the ocean floor surface in the path of the dredge vehicle as it moves forwardly. Generally, along with the nodule particles, the suspension taken in by the nozzles also includes clay particles, silt and other fines that form the generally muddy ocean floor.

The suspension of nodule ore particles and particle fines in water pass upwardly through the nozzles 78 into the ducts 72, then to the combined ducts 80 and, in this embodiment, into and through the impeller chambers of the pumps 82. The suspension exhausted from the pump outlet continues through the combined ducts 80 and into the stripper section 84 where the ducts 80 change into the rectangular ducts 80*a*, 80*b*, which are stacked in a vertical array in two columns. The generally rectangular ducts 80*a*, 80*b*, although of a different shape from the combined ducts 80 have substantially the same cross-sectional area.

Figure 3:
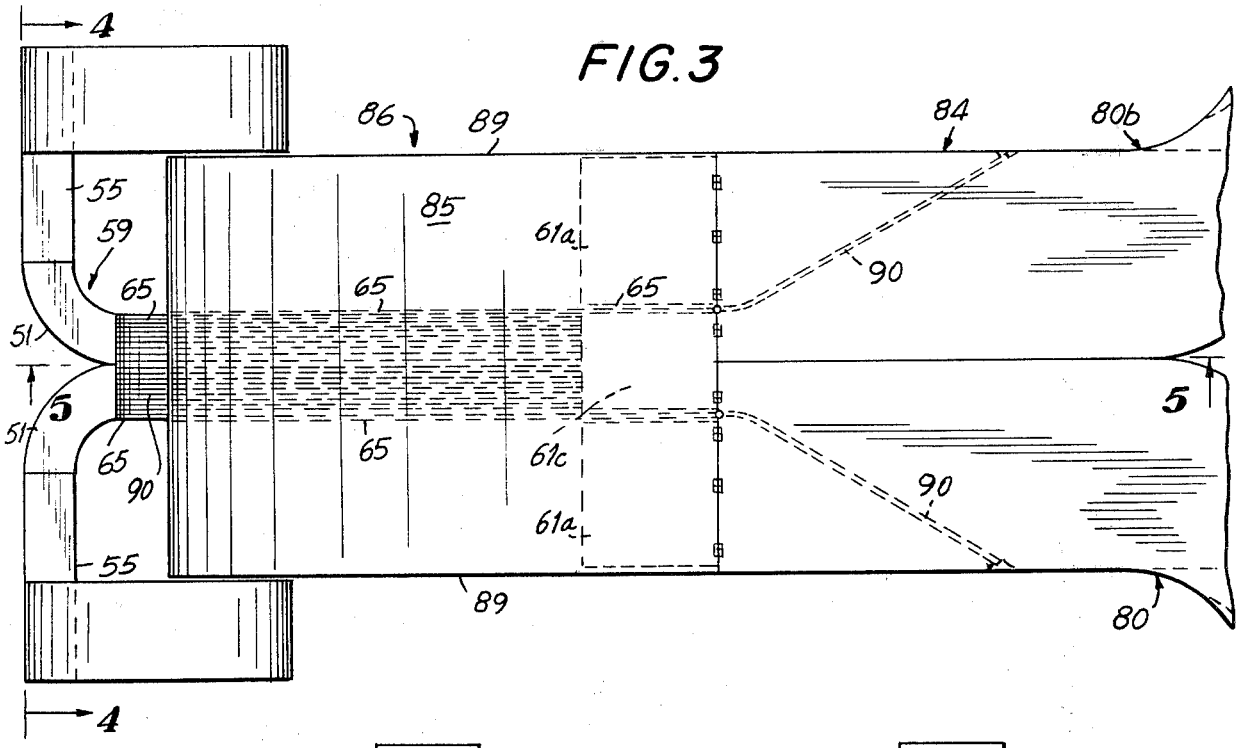
FIG. 3 is a partial, enlarged plan view of the rear portion of the dredge assembly of this invention on lines 3—3.

When the screens 90 are in the closed position, e.g., as shown in FIGS. 1 and 3, a major portion of the suspending water (e.g., about two-thirds by volume) in the ducts 80*a*, 80*b*, pass outwardly through the screen openings 90, i.e., between the parallel slender rods 91, carrying with them a large proportion of the fine particles. The larger particles, of a size too large to pass between the slender rods (e.g., approximately $\frac{1}{4}$-inch rods on $\frac{5}{8}$-inch centers) are channeled between the screens 90, such that the exhaust from all of the six ducts 80*a*, *b* flows into the central flow section of the manifold diffuser defined by the inner walls 65. The water and fines passing outwardly through the screens 90 are exhausted back into the ocean from the ducts 80*a*, 80*b* through the respective outer flow section within the diffuser manifold 86 in a rearward direction.

Within each section in the manifold diffuser 86, the pressure of the moving fluid suspension is gradually diminished as a result of the outwardly flaring upper and lower walls 85, 87, thereby improving the efficiency of the assembly. The concentrated suspension of the nodule ore particles in the central flow section although also exposed to the diffuser effect, is subject to a further separation, by the secondary screen 63, of the majority of the remaining water and fines from larger nodule ore particles. The water-and-fines suspension is exhausted rearwardly of the secondary screen 63 into the ocean. The larger ore particles, restrained from passing through the secondary screen 63, remain with sufficient forward momentum to move downwardly through the central flow section, generally sliding down along the upper surface of the lower flaring wall 87, into that portion of the central flow section extending rearwardly of the manifold diffuser 86 (indicated as "A" in the drawing of FIG. 5), and into the airlift feed section 59. The velocity within the airlift feed section 59 is such that that section substantially constitutes a transient reservoir, or hopper, for the ore particles prior to their being moved into the vertical airlift system through the feed pipe 88.

In the preferred embodiment shown in the accompanying drawings, the water which is used to transport the nodule ore particles from the feed section 59, through the feed pipe 88, and into the vertical airlift system, is substantially clear water drawn in through the clear water duct 55. This eliminates any problem that may be caused by any deleterious substances in the ocean floor mud, that would otherwise be brought to the surface of the ocean. The inlet to the clear water duct 55 is located at a sufficient height above the dredge nozzles 78 that the mud cloud necessarily stirred up by the nozzles and by the sled runners moving through the mud, is below the intake level. In this manner, the suspending water carrying the ore particles from the feed section 59 into and through the section pipe 88 and to the vertical airlift pipe is substantially clear of mud particles thereby avoiding the potential problems that some thought may exist.

In the preferred example, the total cross-sectional area of the manifold 86 is increased by a factor of about four, reducing rearward fluid flow by about the same factor.

The rate of feed of the nodule ore particles to the airlift pipe can be controlled by, for example, pivoting the screens 90 about a downstream pivot point, so as to open a portion of the ducts 80*a*, 80*b* to flow of the ore particles into and through the outer diffuser sections. In the event of an ore particle jam that may be formed in the hopper-like, airlift feed section 59, the rearmost lower portion of the suction pipe 88 can be pivoted downwardly, as exemplified by the dump door 61, and the rear and bottom portion of the clear water duct 55 can be pivoted downwardly and rearwardly as exemplified by the pivoting dump door 51, as shown in FIG. 5, to dump out any such jam or blockage.

When designing the dredge assembly in accordance with the present invention the sizing of the ducts is dependent upon the flow rate generated by the pumps 82. Similarly, the relative slopes of, and angles between, the flaring upper and lower walls 85, 87 of the manifold diffuser 86 is determined by the total flow of water and by the desired final velocity of the large ore particles passing outwardly through the central flow section of the diffuser. The rate of diffusion must be such as to leave the ore particles with sufficient forward velocity to move outwardly through the diffuser section and into the nodule collection hopper 59; the velocity should not be sufficiently great to cause breaking apart of the ore particles upon crashing into the secondary screen 63. By proper design of the widest portion of the diffuser trumpet, a slight eductor effect can be created to bring in clear water upwardly from the feed section 59, serving to sweep away any remaining silt and mud outwardly through the secondary screen 63, thereby further reducing the amount of silt brought with the ore particles into the airlift suction pipe 88.

The diffuser plates 61 are provided to prevent flow disruption in the event that any one of the pumps 82 should malfunction. So long as all of the pumps are operating properly and the flow of water through all of the ducts 80 remain substantially equal, the diffuser plates 61 are maintained in their extended, parallel position shown in FIG. 5. In the event that any one of the pumps should fail either completely or partially, and the flow through, e.g., the lowest duct 80*a* decreases, the lower diffuser plate 61 pivots downwardly, thereby cutting off that lower duct 80*a* from flow, preventing undesirable backflow and diminishing any flow unevenness in the manifold diffuser chamber 86, that might otherwise result.

The patentable embodiments of this invention which are claimed are:

1. A dredge vehicle for moving forwardly along the ocean floor and a dredge assembly for collecting solid ore particles from the ocean floor and delivering the ore particles to an elevator means, the dredging assembly comprising:

collection means to collect solid particles from the ocean floor mixed with a relatively large quantity of water, the collection means extending transversely across a forward portion of the dredge vehicle;

pumping means in series fluid flow connection with the collection means, and so designed that during operation a flow comprising a suspension of solid ore particles with a relatively large quantity of water is accelerated from the collection means through the pumping means;

pump conduit means having a first end and a second end, the first end being in fluid flow connection with the pumping means;

ore particle screening means in fluid flow connection with the second end of the pump conduit means to separate solid particles from at least a portion of the water in the pump conduit means;

elevator feed conduit means in fluid flow connection with the second end of the pump conduit means and designed to feed solid particles not passed by the screening means to an elevator means leading to the ocean surface; and a manifold in fluid flow connection with the pump conduit means, the manifold comprising an elevator feed manifold conduit and an exhaust manifold conduit, the screening means being in fluid flow connection between the pump conduit means and the exhaust manifold, whereby a majority of the water and solid particles below a predetermined size are passed by the screening means to the exhaust manifold.

2. The dredge vehicle of claim 1 comprising support means designed to rest upon the ocean floor and wherein the collection means extend forwardly of the support means.

3. The dredging assembly of claim 2 wherein the collection means comprises a plurality of suction nozzles.

4. The dredge assembly of claim 3 comprising a plurality of pumps in fluid flow connection with a plurality of pump conduit means.

5. The dredge assembly of claim 4 further comprising a second ore particle screening means supported within the elevator feed manifold conduit and designed to separate at least a majority of any remaining water from the previously screened solid particles; a suction feed conduit designed to connect into the airlift; and a collection section for solid particles in intermediate flow connection between the elevator feed manifold conduit and the suction feed conduit.

6. The dredge assembly of claim 5 further comprising clear water means to feed substantially clear water to the separated ore particles in the collection section.

7. The dredge assembly of claim 6 wherein the clear water means comprises an intake opening located sufficiently above the dredge vehicle as to be above a cloud of mud generated by the vehicle during movement along the ocean floor and operation of the dredging assembly.

8. The dredge assembly of claim 6 wherein the manifold comprises a rearwardly diverging diffuser section for reducing the fluid pressure exerted by the flowing stream of solid particles and water therein, the second screening means being located downstream of at least a portion of the diffuser section.

9. The dredging assembly of claim 8 wherein the fresh water intake duct is in fluid flow connection with the collection section and wherein the flow connection between the collection section and the diffuser section results, during operation of the dredging assembly, in an eductor effect resulting in the flow of clear water from the collection section into and through the airlift feed manifold conduit, whereby the passage of particles smaller than the predetermined size into the collection section is effectively reduced and such particles pass outwardly through the second screen means with the flowing water.

10. A dredge vehicle for moving forwardly along the ocean floor and a dredge assembly for collecting ore particles from the ocean floor and delivering the ore particles to an airlift pipe system, the dredge assembly comprising:

a plurality of pumping means;

a plurality of nozzles for collecting solid ore particles from the ocean floor, arrayed across the forward portion of the dredge vehicle, each nozzle being in fluid flow connection with a pumping means, and so designed that during operation a flow comprising a suspension of solid ore particles in water is accelerated into and through a nozzle and passes rearwardly to and through the pumping means, each nozzle being in parallel fluid flow relationship to the other nozzles and in series fluid flow with a pumping means;

a plurality of first conduit means each conduit means having a first forward end, in fluid flow connection with a pump, and having a second rearward end;

a manifold in fluid flow connection with the second end of each of the first conduit means, the manifold comprising an airlift feed manifold diffuser section and an exhaust manifold conduit section, both manifold sections extending rearwardly from, and being connected with the second end of each of the first conduit means;

a screening means supported between the first conduit means and the exhaust manifold conduit, the screening means permitting the passage of water and solid particles smaller than a predetermined size;

second screening means within the airlift feed manifold diffuser designed to separate out at least a major portion of the remaining suspending water with the small particles;

a transient reservoir section in fluid flow connection with the airlift feed manifold diffuser; and an airlift suction pipe in fluid connection with the transient reservoir designed to connect with an elevator means to a surface vessel.

11. The dredge assembly of claim 10 comprising clear water feed means in fluid flow connection with the transient reservoir section and an eductor section between the transient reservoir and the airlift manifold diffuser whereby clear water flows from the reservoir to the airlift feed manifold to remove additional small particles outwardly through the second screen means.

12. The dredge assembly of claim 11 wherein the intake to the clear water feed is situated vertically above the dredge vehicle at a sufficient height to be clear of any cloud of silt or fines generated by moving the dredge vehicle along the ocean floor.

13. The dredge assembly of claim 10 or 11 wherein the screening means comprises an array of relatively slender rods separated by a distance suitable for preventing the passage of solid particles of greater than a predetermined size.

14. The dredge assembly of claim 10 wherein the manifold is a diffuser and is laterally divided into the airlift feed manifold diffuser and exhaust manifold diffuser.

15. The dredge vehicle of claim 10 comprising in addition at least two skid runners, and wherein the suction nozzles are arrayed forwardly of the skid runners.

16. The dredge assembly of claim 10 wherein at least two nozzles are in series fluid flow connection with each pumping means.

17. The dredging assembly of claim 10 wherein the manifold is a duffuser comprising two exhaust sections and a single airlift feed section intermediate the exhaust sections, and wherein the first conduit means are arrayed in two vertical columns immediately adjacent the manifold diffuser, and wherein the screening means separate each of the first conduit means into two flow sections, a first flow section in fluid flow connection with the airlift feed manifold diffuser and the second flow section in fluid flow connection with one exhaust manifold diffuser.

18. The dredge vehicle of claim 10 comprising in addition dump door means situated at the rear lowermost point of the transient reservoir and airlift feed suction pipe.

19. The dredging assembly of claim 10 wherein the manifold diffuser is defined by outwardly diverging upper and lower surfaces.

20. The dredging assembly of claim 10 comprising in addition movable flow deflectors designed to impede flow between the manifold diffuser and a first conduit in the event of failure of the pumping means in fluid flow connection with said first conduit, whereby the effect of such failure of fluid flow upon the flow in the remaining first conduit means is reduced.

21. The dredge assembly of claim 10 comprising in addition a pump conduit means between the nozzle and the pump wherein the nozzle is pivotably supported relative to the pump conduit means.

22. A dredge vehicle for moving forwardly along the ocean floor and a dredge assembly for collecting solid ore particles from the ocean floor and delivering the ore particles to an elevator means, the dredging assembly comprising:

collection means to collect solid particles from the ocean floor mixed with a relatively large quantity of water, the collection means extending transversely across a forward portion of the dredge vehicle and comprising a plurality of suction nozzles;

support means designed to rest upon the ocean floor and wherein the collection means extend forwardly of the support means;

pumping means comprising a plurality of pumps in series fluid flow connection with the collection means, and so designed that during operation a flow comprising a suspension of solid ore particles with a relatively large quantity of water is accelerated from the collection means through the pumping means;

a plurality of pump conduit means each having a first end and a second end, each first end being in fluid flow connection with a pump;

ore particle screening means in fluid flow connection with the second end of the pump conduit means to separate solid particles from at least a portion of the water in the pump conduit means;

elevator feed conduit means in fluid flow connection with the second end of the pump conduit means and designed to feed solid particles not passed by the screening means to an elevator means leading to the ocean surface; and a manifold in fluid flow connection with each of the pump conduit means, the manifold comprising an elevator feed manifold conduit and an exhaust manifold conduit, the screening means being in fluid flow connection between the pump conduit means and the exhaust manifold, whereby a majority of the water and solid particles below a predetermined size are passed by the screening means to the exhaust manifold.

* * * * *